United States Patent [19]

Momot

[11] Patent Number: 4,968,273

[45] Date of Patent: Nov. 6, 1990

[54] WATER-BORNE VESSEL

[76] Inventor: Adam Momot, 2 - 335 W. 15th Avenue, Vancouver, British Columbia, Canada, V5Y 1Y3

[21] Appl. No.: 411,690

[22] Filed: Sep. 25, 1989

Related U.S. Application Data

[63] Continuation-in-part of Ser. No. 69,036, Jun. 30, 1987, abandoned.

[51] Int. Cl.[5] ..... A63C 15/04

[52] U.S. Cl. ..... 440/14; 440/22; 440/9

[58] Field of Search ..... 440/9, 13, 14, 21, 22; 416/79-83

[56] References Cited

U.S. PATENT DOCUMENTS

| | | | |
|---|---|---|---|
| 1,838,519 | 12/1931 | Antoni | 440/13 |
| 2,021,815 | 11/1935 | Strout | 440/14 |
| 2,367,765 | 12/1945 | Fickler | 440/14 |
| 2,854,787 | 10/1958 | Oberg | 440/13 |
| 2,962,283 | 11/1960 | Casey | 440/14 |
| 3,773,011 | 11/1973 | Gronier | 440/14 |
| 3,833,956 | 9/1974 | Meehan | 440/14 |
| 4,332,571 | 6/1982 | Jakobsen | 440/9 |
| 4,371,347 | 2/1983 | Jakobsen | 440/9 |

FOREIGN PATENT DOCUMENTS

| | | | |
|---|---|---|---|
| 62624/69 | 4/1971 | Australia . | |
| 523442 | 7/1982 | Australia . | |
| 1311593 | 1/1962 | France . | |
| 2453774 | 4/1979 | France . | |
| 57-14607 | 9/1983 | Japan | 440/9 |
| 58-133997 | 9/1983 | Japan . | |

*Primary Examiner*—Joseph F. Peters, Jr.
*Assistant Examiner*—Edwin L. Swinehart
*Attorney, Agent, or Firm*—Fulwider Patton Reiber Lee & Utecht

[57] ABSTRACT

A propulsion system for a water-borne vessel. There is a generally inflexible fin member. A projection member is connected to the vessel. It has a resilient connecting member attached to the generally inflexible fin member. The projection member is connected to the vessel so as to be held below water along an axis parallel to the water line.

2 Claims, 4 Drawing Sheets

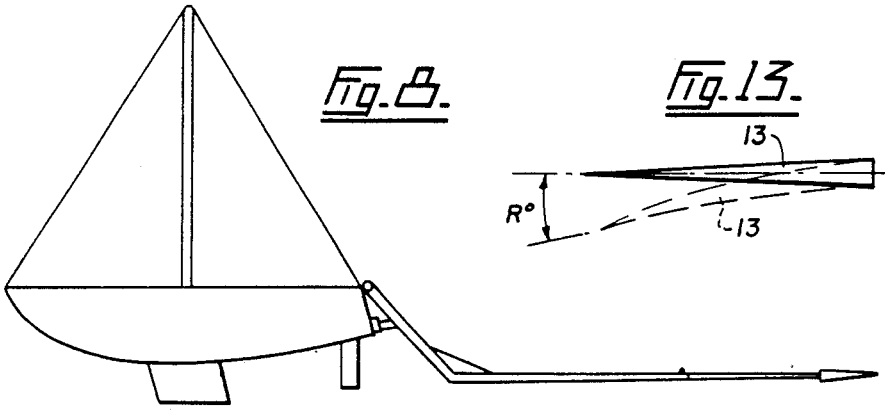
Fig. 8.
Fig. 13.
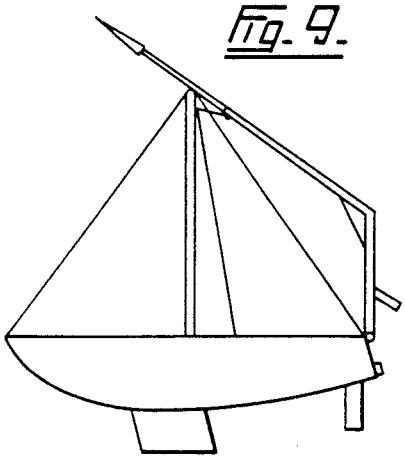
Fig. 9.
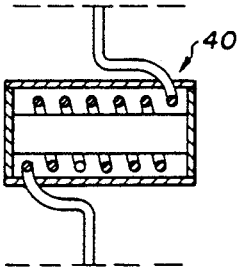
Fig. 11.
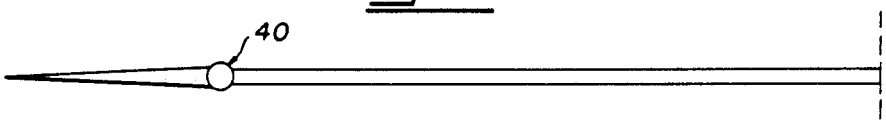
Fig. 10.
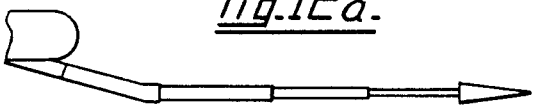
Fig. 12a.
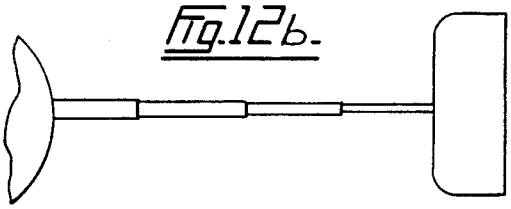
Fig. 12b.

WATER-BORNE VESSEL

The present application is a continuation-in-part of Ser. No. 069,036 filed June 30, 1987, now abandoned the disclosure of which is incorporated herein by reference.

FIELD OF THE INVENTION

This invention relates to propulsion systems for water-borne vessels and especially, but not exclusively, to a propulsion system of the kind that can propel the vessel forward by either utilizing wave energy or by causing said vessel to oscillate alternatively in an upward or downward direction from a predetermined horizontal position.

DESCRIPTION OF THE PRIOR ART

Various attempts have been made to provide a propulsion system for water-borne vessel which can either be used when the vessel is at rest and water pressure from incident waves provide energy to propel the vessel forward or when the vessel is allowed to oscillate alternatively in an upward or downward direction from a predetermined horizontal position thereby permitting said vessel to be propelled forward.

For example, U.S. Pat. No. 3,453,981 discloses a water-borne vessel comprising a propulsion system incorporating flexible fin propulsion members. This type of system provides relatively little power or forward motion to a vessel due to the relatively small stroke provided by the flexible fins used in the system. Also, such a vessel cannot be propelled forward when the water is calm and free from waves.

Another propulsion system is disclosed in U.S. Pat. No. 3,773,011. However this system cannot utilize the incident wave energy to propel the vessel forward since it requires the alternative upward and downward oscillation of the vessel by a user. This system has the disadvantage of tiring its user fairly quickly and providing little forward motion of the vessel.

There therefore exists a requirement for a propulsion system for use on water-borne vessels capable of using incident wave energy for propelling the vessel forward, as well as a system able to be propelled forward by the oscillation of the vessel when there is little wave energy available to propel the vessel forward.

SUMMARY OF THE INVENTION

Accordingly, a first object of the present invention is to provide a propulsion system for a waterborne vessel wherein water pressure from incident waves acting upon said vessel will be such that the alternate upward and downward pitching oscillation of said vessel will result in the transfer of energy from said vessel to the propulsion system.

A second object of the present invention is to provide a propulsion system for a water-borne vessel wherein the vessel can be propelled forward when said vessel is caused to oscillate by pitching alternately upwardly and downwardly so as to result in the transfer of energy from said vessel to a propulsion system.

A third object of the present invention is to provide a propulsion system for a water-borne vessel wherein the vessel can be propelled forward by utilizing drive means which causes the propulsion system to oscillate alternatively in an upward and downward direction against water pressure, from a predetermined horizontal position such that the resilience of the propulsion system urges it to return to its horizontal position thereby causing the vessel to be propelled forward.

A fourth object of the present invention is to provide a propulsion system for a water-borne vessel wherein the vessel can be propelled forward when the uplift force of water from incident waves on the propulsion system will be such as to bend the propulsion system alternatively in an upward and downward direction from a predetermined horizontal position such that flexibility and resilience of the propulsion system urges it to return to its horizontal position thereby causing the vessel to be propelled forward.

Accordingly, an aspect of the present invention is to provide a propulsion system for a water-borne vessel, comprising: a generally inflexible fin member; a projection member connected to said vessel having resilient connecting means attached to said generally inflexible fin member and wherein said projection member is connected to said vessel to as to be held below water along an axis parallel to the water line.

DRAWINGS

Particular embodiments of the invention will be understood in conjunction with the accompanying drawings in FIGS. 1 to 2 are illustrations showing the theoretical forces acting on the vessel and the propulsion system from an incident wave.

Figure 5A:
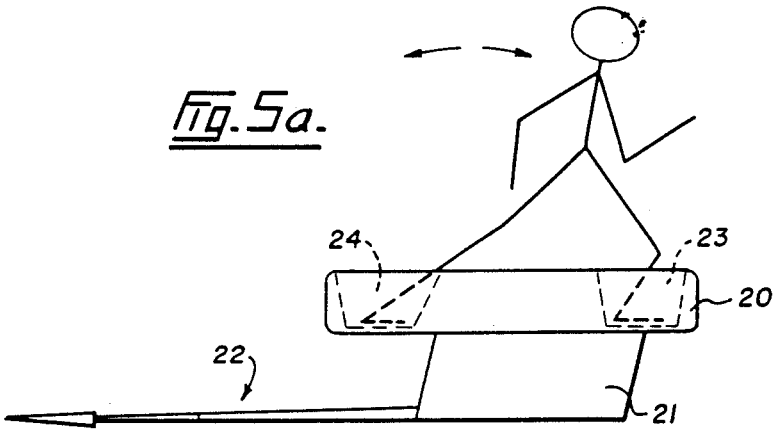
Figure 5B:
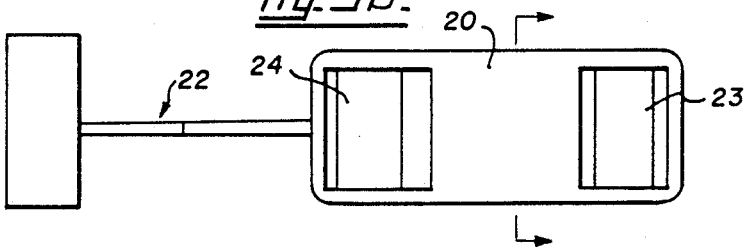
Figure 5C:
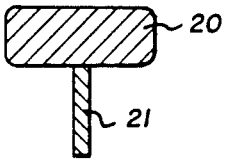
Figure 6:
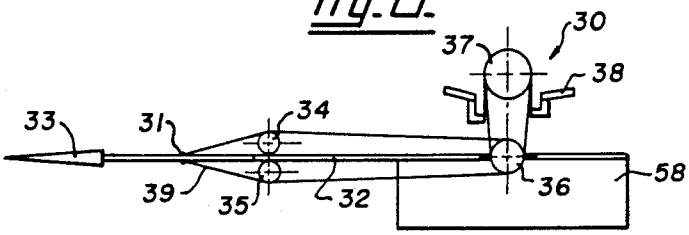
Figure 7:
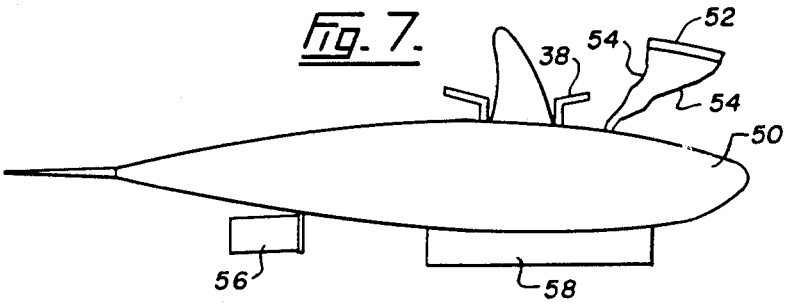
Figure 14:
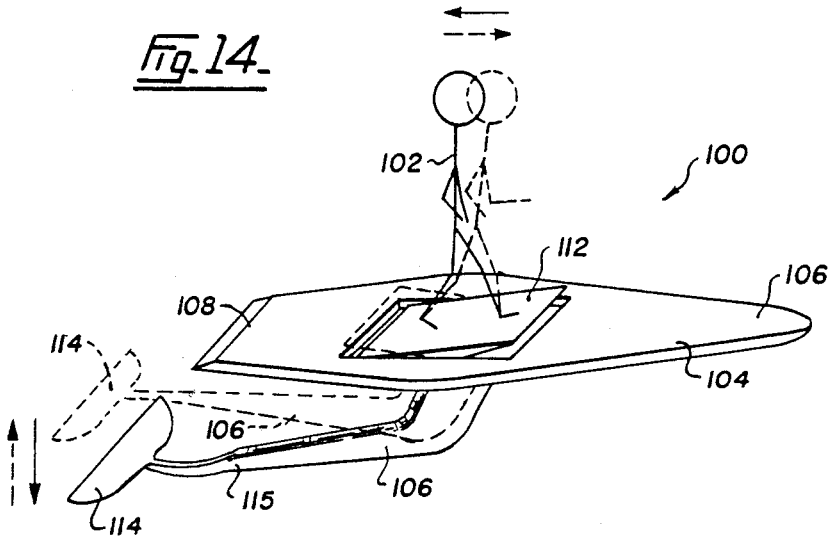

FIGS. 5*a*, 5*b* and 5*c* illustrate the propulsion system secured to a toy;

FIG. 6 is an illustration of a drive means according to the third object of the present invention;

FIG. 7 is an illustration of a toy for use with the drive means of FIG. 6;

FIGS. 8 and 9 are illustrations of the propulsion system for use in conjunction with a sailboat;

FIG. 10 is an illustration of the propulsion system using a spring joint;

FIG. 11 is a cross section of the spring joint of FIG. 10;

FIGS. 12*a* and 12*b* are illustrations of a telescopic construction for the propulsion system;

FIG. 13 shows a detail of the operation of the fin;

FIG. 14 shows a further embodiment of the invention; and

Figure 15:
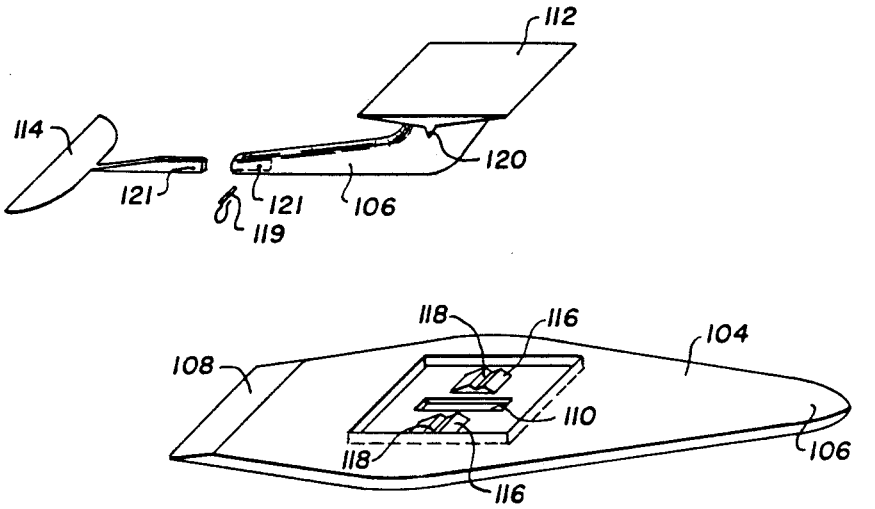

FIG. 15 is an exploded view of the embodiment of FIG. 14.

DESCRIPTION OF THE PREFERRED EMBODIMENTS

Figure 1:
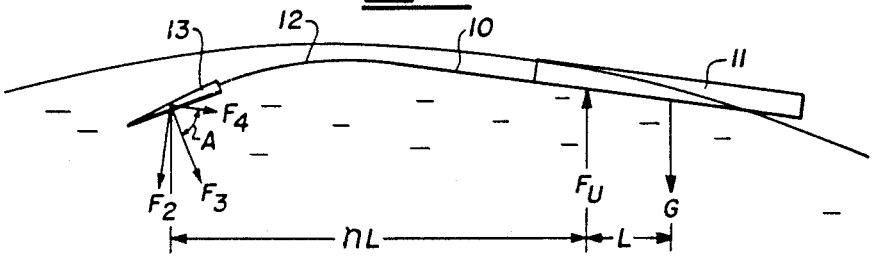
Figure 2:
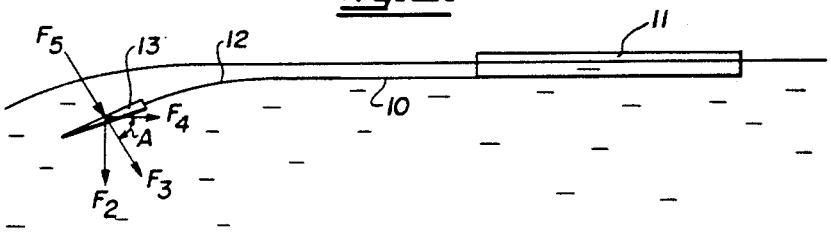

Referring now to FIGS. 1 and 2 we have shown an illustration of the theoretical forces that can act on a water-borne vessel and the propulsion system disclosed in the present invention. The propulsion system includes an elongated inflexible projection member 10 secured at one end to a vessel 11 and attached at another end to a flexible connecting member 12 which is connected to a generally inflexible fin 13. The uplift force Fu of an incident wave reacts on the propulsion system to create a force $F_3$ having a component $F_4$ parallel to the water line of the vessel and component $F_2$ perpendicular to the water line of the vessel. $F_4$ is the force which will propel the water-born vessel forward. Assuming that the vessel is provided with a projection of a length nL, $F_4$ can be determined according to the following equation:

$$Fu \times L = F_3(n+1)L$$

wherein Fu is the resultant uplift force on the vessel, L being the distance from the centre of gravity G of the vessel to the centre of uplift force Fu acting on the vessel and n is a positive integer. Accordingly, we have $$F_3 = \frac{Fu \times L}{L(n+1)} = \frac{Fu}{n+1}$$

$$\frac{F_4}{F_3} = \text{Cos}A \text{ and } F_3 = \frac{F_4}{\text{Cos}A}$$

$$\text{therefore } \frac{\text{Fu}}{n+1} = \frac{F_4}{\text{Cos}A}$$

$$\text{and } F_4 = Fu\frac{\text{Cos}A}{n+1} = \text{Propulsion Force}$$

As can be seen from FIGS. 1 and 2, an incident wave arriving at the vessel will be such as to create a force Fu on vessel 11 and a reactive force $F_3$ on fin 13. The uplift force Fu on vessel 11 will be quite significant compared to the weight of the vessel and the energy created by the wave will be transmitted from the vessel to fin 13 through inflexible member 10 and flexible member 12. These forces will combine to propel the vessel forward. The uplift force Fu on vessel 11 will of course be much greater than the reactive force $F_3$ on fin 13 and the tremendous energy created by the wave will be transmitted from the vessel to fin 13 upon bending of flexible member 12.

Referring now to FIG. 2, force $F_5$ represents the force initiated by an incident wave. As a wave rolls over the water, the crest of the wave creates a downward force $F_5$ thereby forcing the generally inflexible fin 13 to move downwardly with a force $F_3$. The force $F_3$ has a component $F_4$ parallel to the water line of the vessel and component $F_2$ perpendicular to the water line of the vessel. Force $F_4$ propels the water-born vessel forward. The alternate upward and downward motion of the generally inflexible fin is permitted by the bending of the flexible connecting member 12 connected between the generally inflexible fin 13 and the elongated inflexible projection member 10 which is further connected to the stern of vessel 11.

In FIG. 2, $$F_5 = F_3$$

$$F_4 = F_3 \text{ Cos } A$$

The resiliency of the flexible connecting member will accordingly exert an opposite force as the flexible projection member tends to return to its normal position which lies parallel but below the water line of the vessel.

The generally inflexible fin member 13 can be undergoing minimal deformation. However deformation of the fin can cause a significant loss of propulsion and thus decrease the effectiveness of the propulsion system while moving fast. Thus any deformation R° should be small.

Figure 3:
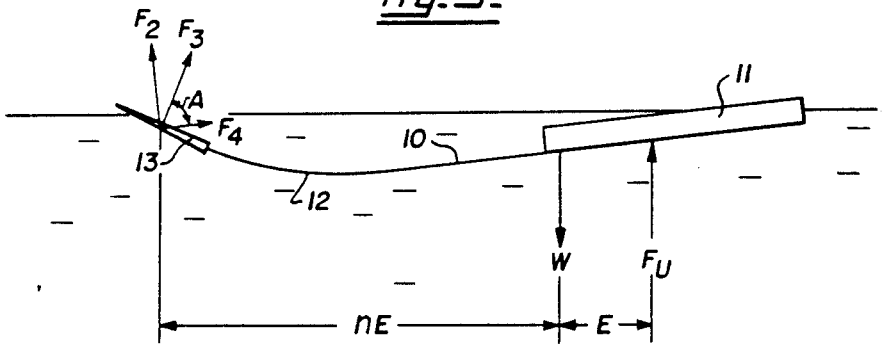
FIG. 3 is an illustration of the theoretical forces acting on the propulsion system when an external force W is applied to the vessel.

FIG. 3 illustrates the effect on the propulsion system of an external force applied to the vessel. If a weight W is applied at the stern of the vessel, the propulsion system will react by moving downwardly. Water pressure on the fin will result in the bending of the flexible projection member 12 as shown in FIG. 3. Alternatively, if a weight is applied towards the front end of the vessel, the propulsion system will move upwardly thereby forcing the flexible connecting member to bend in the direction opposite to that shown in FIG. 3. This alternate up and down pitching movement will cause a forward motion of the vessel since energy generated by the external force to the vessel will be transferred to the projection member.

In FIG. 3:

E is the distance from the centre of uplift force Fu to the centre of weight W exerted on the vessel.

Thus:

$$\frac{F_4}{F_3} = \text{Cos}A$$

$$WE = E(n+1)F_3$$

$$\frac{F_4}{\text{Cos}A} = \frac{W}{n+1}$$

$$F_4 \quad \frac{W\,\text{Cos}A}{n+1}$$

Figure 4:
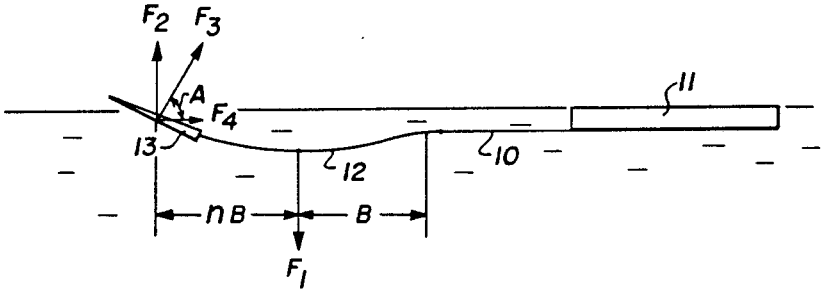
FIG. 4 is an illustration of the theoretical forces acting on the fin when an external force $F_1$ is applied to the propulsion system.

In FIG. 4 the effect of an external force $F_1$ on the propulsion system is depicted. The vessel can be propelled forward by alternatively exerting an upward and downward external force to the propulsion system at the flexible projection member 12.

In FIG. 4 B is the distance from point 31, shown in FIG. 6, to which the ropes of the drive means 30 are coupled to the point where rope pulleys 34 and 35 are coupled.

$$\frac{F_4}{F_3} = \text{Cos}A$$

$$F_1B = F_3(n+1)B$$

$$\frac{F_4}{\text{Cos}A} = \frac{F_1}{n+1}$$

$$F_4 = \frac{F_1\,\text{Cos}A}{n+1}$$

FIG. 5*a* shows a right side view of a toy vessel which can be used with the propulsion system of the present invention. It includes a floating main body 20, a keel 21 to which is secured the propulsion system 22. The floating body includes a front and rear well 23 and 24 respectively within which are positioned the user's feet to allow a user to oscillate the vessel back and forth in a pitching fashion and generate the forces on the propulsion system depicted in FIG. 3. FIG. 5*b* is a top view thereof and FIG. 5*c* is a cross-section view thereof.

An external force $F_1$ exerted on the propulsion system as disclosed in FIG. 4 can be applied to the flexible projection member by using the drive means shown in FIG. 6. By using this embodiment a user can propel the vessel forward by using the drive means 30 coupled to the flexible resilient member 31 between the inflexible projection member 32 and the fin 33. This can be achieved by using a series of rope pulleys 34 and 35, rope sheaves 36 and 37. Pedals 38 are used to apply the oscillating movement to the flexible projection member 31. FIG. 7 depicts a toy for use with the drive means shown in FIG. 6.

FIG. 7 shows a hull 50 mounted, for example, over the drive means as shown in FIG. 6. There is a steering handle 52 attached to ropes 54 attached by conventional means, not shown, to a rudder 56. This permits steering of the vessel. A keel 58 is provided.

The propulsion system of the present invention can also be secured to an ordinary boat, for example a sail boat as shown in FIGS. 8 and 9 thereby permitting forward motion of the vessel by utilizing the wave energy, which can be particularly effective in stormy weather and rough seas. The propulsion system can also be permanently secured to the keel of the vessel.

FIG. 10 shows another embodiment of the propulsion system in which the flexible projection member is replaced by a spring joint 40 connecting the generally inflexible fin to the inflexible projection member which is secured to the vessel. FIG. 11 depicts a cross-sectional view of the spring joint assembly shown in FIG. 10. FIG. 12*a* depicts a side view of the telescopic construction propulsion system and how it can be secured to a vessel, life boat or rubber raft. FIG. 12*b* is a top view thereof.

FIG. 14 shows a further embodiment to the invention which is a water-borne vessel 100 to be propelled by an operator 102 on the vessel. This embodiment comprises a hull 104 having a bow 106 and a stern 108. There is an opening 110 in the hull 104. The principal feature of this embodiment is the provision of a platform 112 to receive the operator 102.

The platform 112 is able to rock about on an axis transverse to the hull 104. There is an inflexible linking member 106 extending downwardly from the platform 112, as shown most clearly in FIG. 15, through the opening 110, as shown most clearly in FIG. 14, and rearwardly towards the stern 108. There is a flat generally inflexible fin 114 joined to the rear of said inflexible linking member by a resilient joint at 115. The generally inflexible fin 114 has a flat body that extends outwardly from the distal end of the resilient joint to lie generally parallel to the water surface. The arrangement, as shown in FIG. 14, is such that rocking the platform 112, placed in the hull 104, by the operator 102 shifting his or her weight fore and aft reciprocates the generally inflexible fin 114 to propel the vessel.

As shown in FIG. 14 the hull 104 is generally flat and is preferably made of a buoyant material, for example as is common in surfing boards and wind sailing boards. To facilitate the rocking of the platform 112, the hull 104 is desirably provided with projections 116 extending upwardly from each side of the opening 110 and those projections are formed with recesses 118 on their top surfaces. Corresponding projections 120 extend downwardly from the platform 112 to be received one in each recess in the projections 116 on the hull 104.

As shown in FIG. 14, the resilient joint 115 comprises a flexible portion between the inflexible linking member and the generally inflexible fin 114. However, FIG. 15 shows the use of a pin 119 extending through alignable openings 121 in the inflexible linking member and a resilient joint from the generally inflexible fin 114.

I claim:

1. A water-borne vessel to be propelled by an operator on the vessel, the vessel comprising:

a hull having a bow and a stern;

an opening in the hull said opening having opposed sides;

a projection extending upwardly from each side of the opening;

recesses on the upper surfaces of the projections;

the vessel having a propulsion system comprising a platform to receive the standing operator;

projections extending downwardly from the platform to be received one in each of said recesses on the vessel to enable the platform to rock about an axis transverse to the hull;

an inflexible linking member extending downwardly from the platform through said opening in the hull and rearwardly towards the stern;

a flat, generally inflexible fin member joined to the rear of said inflexible linking member by a resilient joint to lie generally parallel to the water surface to be able to reciprocate vertically whereby rocking of the platform reciprocates the fin to propel the vessel.

2. A propulsion system is defined in claim 1 wherein said inflexible fin member can deform to a small degree from the longitudinal plane of the fin.

* * * * *